United States Patent [19]

Hinchcliffe et al.

[11] 4,073,374

[45] Feb. 14, 1978

[54] APPARATUS FOR HANDLING ROD-LIKE ARTICLES

[75] Inventors: Dennis Hinchcliffe; Robert Thomas Daisley; Stanley Bernard Harper; Hilary Mark How'l Kilborn, all of London, England

[73] Assignee: Molins Limited, England

[21] Appl. No.: 648,926

[22] Filed: Jan. 14, 1976

[30] Foreign Application Priority Data

Jan. 23, 1975 United Kingdom ..... 2936/75

[51] Int. Cl.[2] ..... B65G 57/00

[52] U.S. Cl. ..... 198/425; 198/430; 198/454; 198/487

[58] Field of Search ..... 198/20 C, 20, 24, 37, 198/102, 34, 425, 429, 430, 485, 486, 487, 453, 454; 53/148, 236; 214/301, 309

[56] References Cited

U.S. PATENT DOCUMENTS

| | | | |
|---|---|---|---|
| 1,409,224 | 3/1922 | McManus | 198/24 UX |
| 1,472,054 | 10/1923 | Drake | 198/26 X |
| 1,649,639 | 11/1927 | Wright | 198/24 |
| 2,661,830 | 12/1953 | Total | 198/454 |
| 2,682,983 | 7/1954 | Ashcroft | 53/151 |
| 2,778,476 | 1/1957 | Engleson et al. | 198/20 C X |
| 2,907,155 | 10/1959 | Engleson et al. | 198/24 X |
| 3,190,459 | 6/1965 | Kochalski et al. | 198/20 C |
| 3,633,735 | 1/1972 | Molins | 198/37 X |

FOREIGN PATENT DOCUMENTS

| | | | |
|---|---|---|---|
| 8,081 | 12/1896 | Sweden | 53/236 |
| 549,875 | 12/1942 | United Kingdom | 53/236 |

*Primary Examiner*—Evon C. Blunk
*Assistant Examiner*—Douglas D. Watts
*Attorney, Agent, or Firm*—Craig & Antonelli

[57] ABSTRACT

A tray filling unit in which batches of cigarettes, for plunging into a tray, are formed on a conveyor by inserting divider plates into a stream of cigarettes while it is conveyed down an inclined path leading to the conveyor. Successive batches formed on the conveyor are moved transversely off the conveyor onto a movable transfer plate which supports the batch while it is pushed into a tray by the plunger. Trays are moved stepwise downwards to receive successive batches. The basic unit is capable of use in reverse as a tray unloader.

24 Claims, 5 Drawing Figures

APPARATUS FOR HANDLING ROD-LIKE ARTICLES

Figure 1:
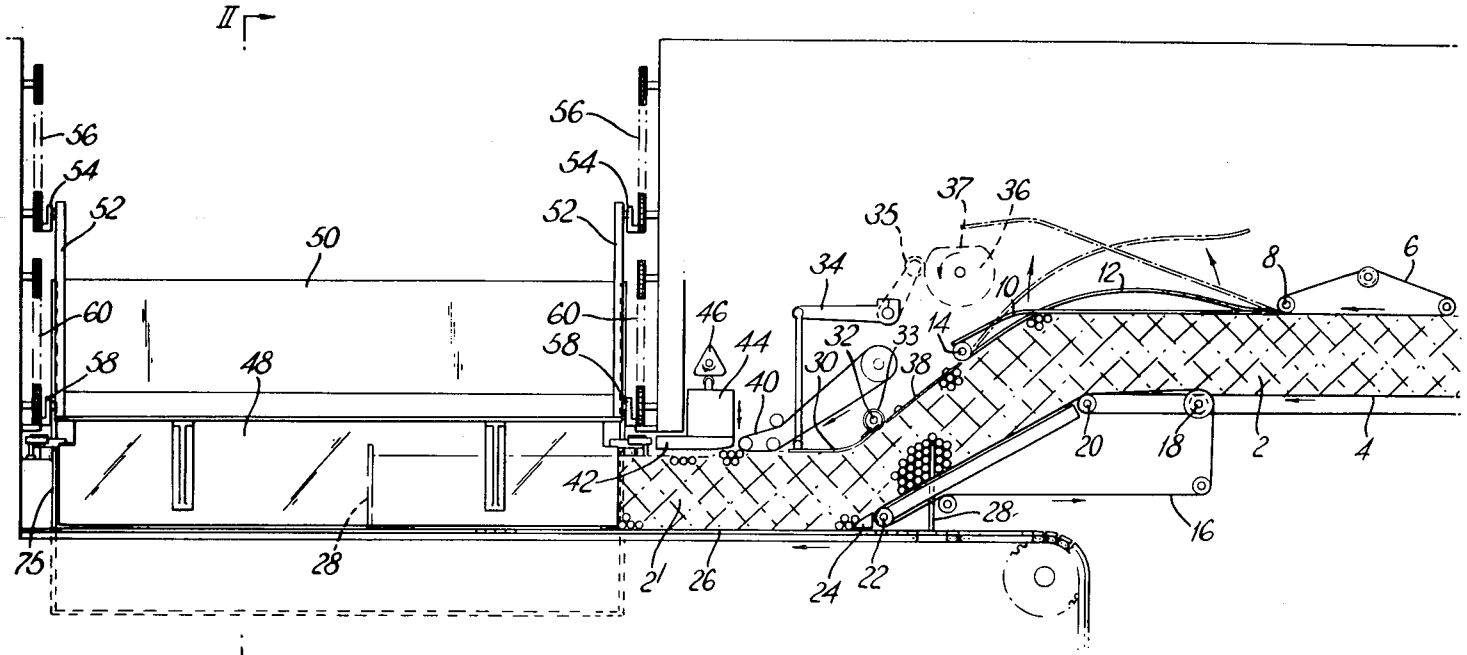

This invention relates to apparatus for handling rod-like articles.

It is common in manufacturing processes for cigarettes to require cigarettes or filter plug lengths to be temporarily transported or stored in containers. This invention is particularly concerned with apparatus for filling a container with rod-like articles, and also concerned with apparatus for unloading such containers. One aspect of the invention provides apparatus for filling a container with rod-like articles, comprising a first conveyor for moving a stream of said articles along a first path, a second conveyor for receiving the stream and for moving it along a second path towards a third path, the second path being inclined to the first path and to the third path, spaced separating means movable with a third conveyor and arranged to be successively projected into the stream on the second path to divide the stream into batches, the third conveyor being arranged to convey the stream in batches along the third path, and means for moving successive batches transversely of said third path off the third conveyor and into a container.

In a preferred arrangement at least the parts of the first and third paths adjacent the second path are parallel; the first and third paths may be respectively upper and lower substantially horizontal paths.

The stream may comprise a continuous stack of cigarettes moving transverse to their lengths. The separating means may comprise a series of regularly spaced divider plates carried at right angles to the third conveyor and adapted to be progressively projected into the stream. The second conveyor may, for example, comprise a pair of transversely spaced belts which support the ends of the lowermost cigarettes in the stream, the divider plates having a width such that they enter the stream between the belts. In one arrangement the upper and lower paths may be substantially horizontal with the third conveyor having a horizontal run which starts under the inclined path defined by the second conveyor so that the divider plates carried by the third conveyor gradually enter the stream on the inclined path as the second and third conveyors converge.

Batches of cigarettes separated by divider plates on the third conveyor may be plunged lengthwise off the conveyor into the container by a piston-type stack pusher. The second and third conveyors are preferably stopped during the plunging operation; a reservoir may be provided near the end of the first conveyor so that this conveyor may continue running. Instead of being plunged directly from the third conveyor into a container, the batches of cigarettes may first be moved onto a transfer plate which subsequently moves with the pusher and carries each batch into the container before being withdrawn prior to withdrawal of the pusher.

Each container may consist of a tray capable of holding several batches of cigarettes on top of one another. After each operation of the pusher the tray may be moved vertically through a distance approximately equal to the height of a batch of cigarettes, so that another batch can be placed on top of the previous batch.

Another aspect of the present invention provides apparatus for unloading a container containing rod-like articles, comprising means for successively transferring batches of articles from the container onto a first conveyor between spaced retaining means carried by said conveyor, each batch comprising a stack of said articles arranged with their lengths transverse to that of the conveyor, a second conveyor for receiving said batches from said first conveyor and for conveying said batches up an inclined path towards an upper path, said first and second conveyors being so arranged that the retaining means is progressively withdrawn as said batches move up said inclined path, and a third conveyor for receiving said batches from said second conveyor as a continuous stream and for conveying said stream along said upper path.

This apparatus for unloading containers and the apparatus for filling containers may be embodied in the same machine and may comprise similar apparatus having alternative modes of operation. The first, second and third conveyors of the filling apparatus then correspond to the third, second and first conveyors respectively of the unloading apparatus. The separating means of the filling apparatus corresponds to the retaining means of the unloading apparatus.

In the unloading apparatus a suction plate which applies suction to the ends of the cigarettes in a batch may be used to withdraw the batches from a container and may constitute the means for transferring batches of articles from the containers. The suction plate may in fact be the pusher for filling containers, suction only being applied when the apparatus is unloading. Alternatively the arrangement may include an unloading pusher (for use with backless trays) or a scoop and may be generally the same as that described and illustrated in U.S. Pat. No. 3,967,740. It should be noted that the present arrangement for loading containers does not require the use of compartmented trays as described in the above-mentioned specification, although use of these is not excluded. If, however, an unloading pusher or a scoop is used for unloading, the use of compartmented trays is recommended.

Certain other features of the arrangement described in the above-mentioned specification are also applicable to the present invention and for this purpose reference is directed to the full disclosure of said specification. In particular the arrangements described for moving batches into a container may be embodied in the present invention. In addition it may be mentioned that, since apparatus of the present invention may constitute apparatus for both filling and unloading containers, the systems described in the said specification relating to such apparatus, capable of reversible modes of operation, are applicable here.

Another aspect of the present invention provides apparatus for forming a stream of rod-like articles into batches or for forming batches of rod-like articles into a continuous stream, the apparatus comprising a first conveyor carrying upstanding spaced divider plates, and a second conveyor inclined to the first conveyor and partly defining a channel through which said stream passes to or from the first conveyor and through which the divider plates on the first conveyor pass, the second conveyor moving faster than the first conveyor so as to have a component of velocity in the direction of the first conveyor at least approximately equal to the velocity of the first conveyor. It is sometimes preferable for said component velocity to exceed the velocity of the first conveyor.

A further aspect of the present invention provides apparatus for filling a container with rod-like articles comprising a conveyor for feeding a stream of rod-like articles, means for successively dividing said stream into batches, and means for moving successive batches transversely off said conveyor into a container, wherein a movable transfer plate is arranged between the conveyor and the container whereby a batch of rod-like articles may be moved transversely off said conveyor onto the transfer plate, the transfer plate moving said batch into the container. Similar apparatus may form part of apparatus for unloading a container so that a batch of rod-like articles is transferred from the container to a conveyor by means of a transfer plate (which may simply provide a surface over which batches may pass between the container and the conveyor). The transfer plate may be used with the loading or unloading apparatus disclosed in the aforesaid British patent specification.

Figure 2:
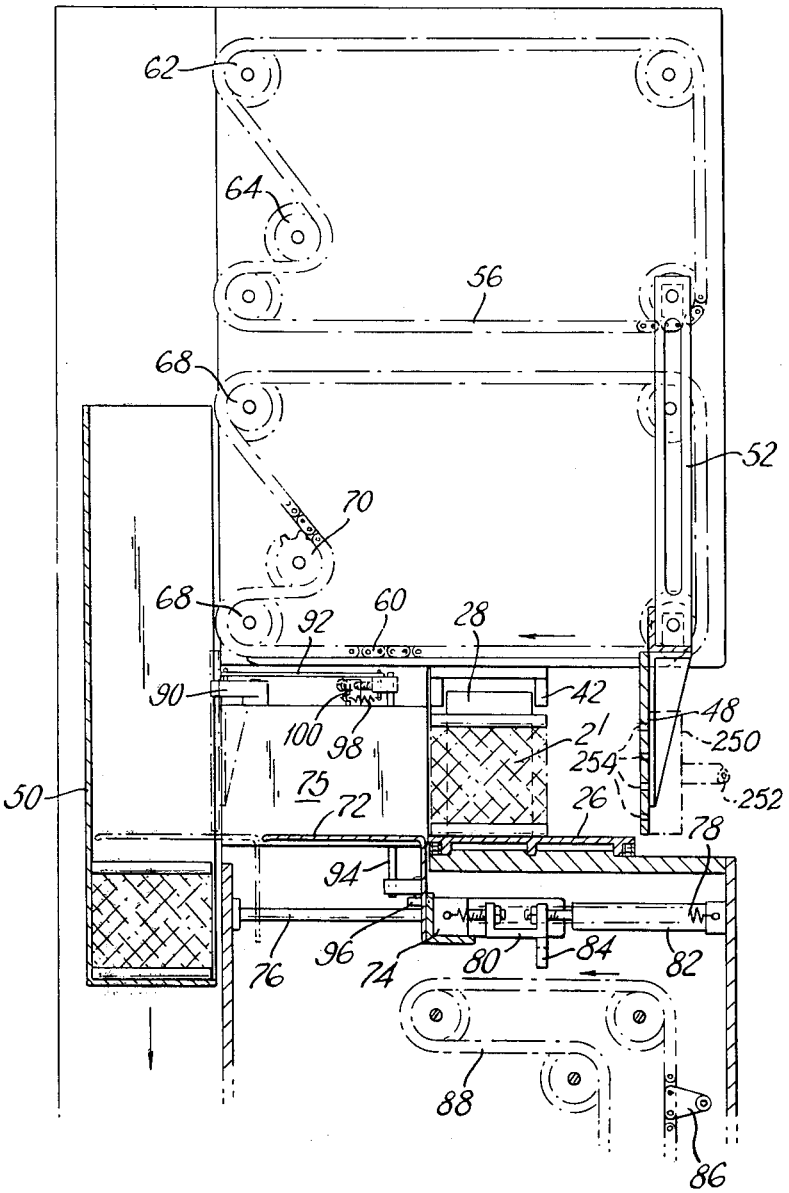
Figure 3:
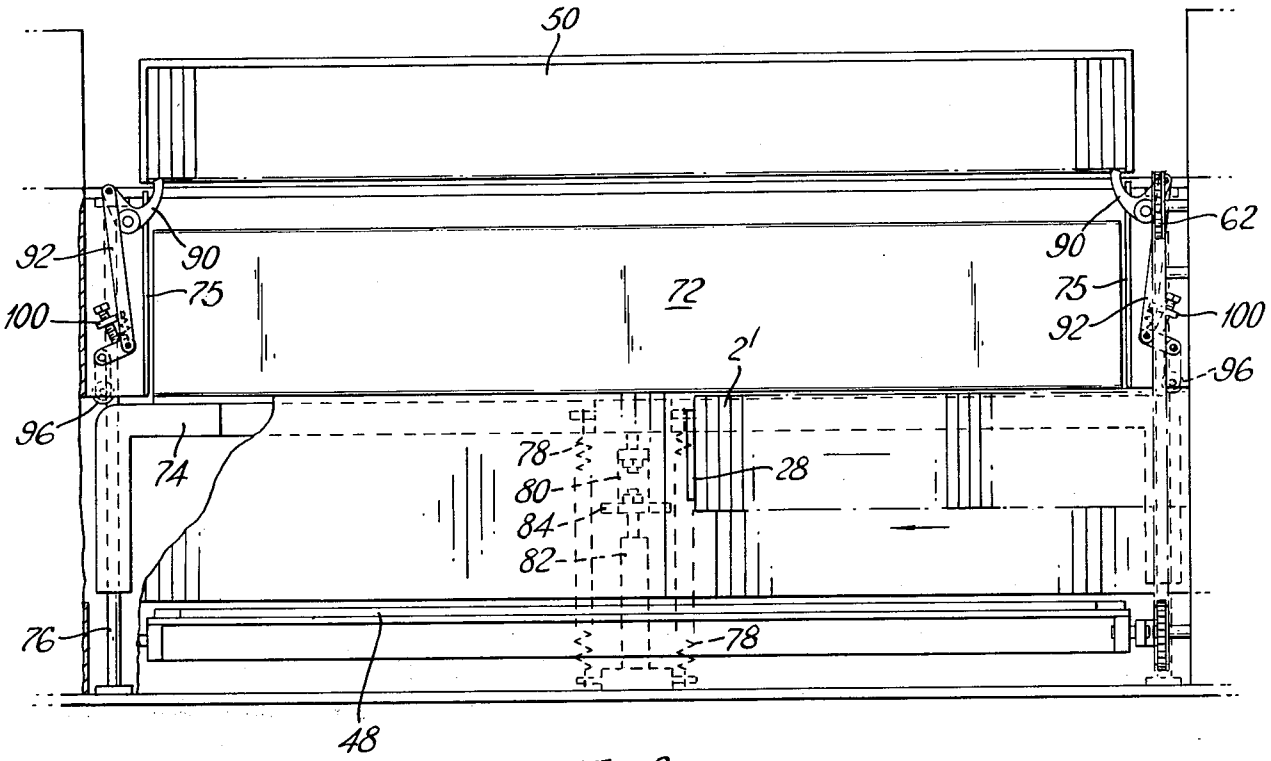
Figure 4:
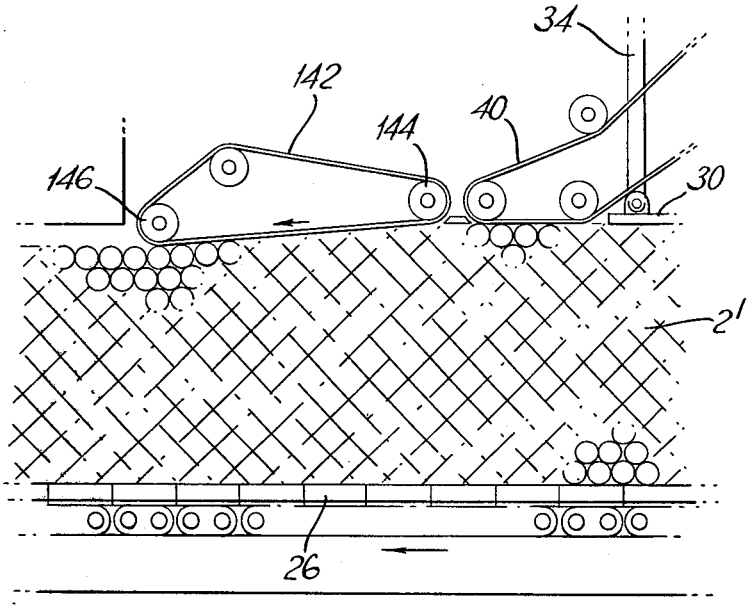
Figure 5:
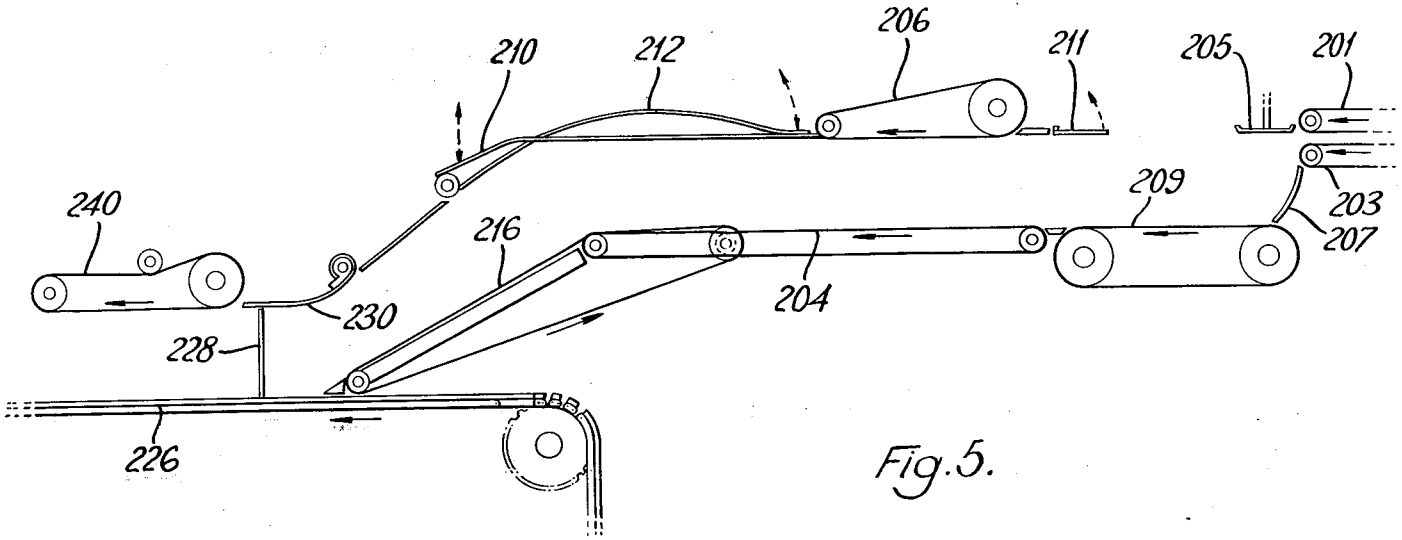

The invention will now be further described, by way of example only, with reference to the accompanying drawings in which:

FIG. 1 is a diagrammatic side elevation of apparatus for filling trays with cigarettes, FIG. 2 is a sectional view on the line II—II of FIG. 1, FIG. 3 is a plan view of part of the apparatus of FIG. 1, FIG. 4 is an enlarged elevational view of a detail modification of the apparatus of FIG. 1, and FIG. 5 is a diagrammatic side elevation of part of an apparatus for filling trays with cigarettes.

Referring to FIG. 1 a stream 2 consisting of a stack of cigarettes is shown supported on an endless band conveyor 4. The cigarettes are arranged with their lengths transverse to the length of the conveyor 4. A top band conveyor 6 is positioned above part of the conveyor 4 and is spaced therefrom by a distance equal to the height of the stream 2. At one end the band 6 passes around a pulley rotatable about an axis 8. Also pivoted about the axis 8 is an arm 10: this consists of a pair of flat strips axially spaced (relative to the axis 8) and connected by a cross member at a position remote from the axis 8. A second arm 12, similarly constructed but having a different longitudinal shape (as shown in FIG. 1), is pivoted about an axis 14 positioned at a lower level than axis 8. The arms 10 and 12 are relatively axially staggered and arranged so that the loops formed by their respective axes, strips and cross members are interlinked. Thus each arm restricts angular movement of the other. Angular movement of the arm 10 in a clockwise direction as viewed in FIG. 1 is eventually restricted by abutment of its cross member with that of arm 12. Similarly angular movement of the arm 12 in an anticlockwise direction as viewed in FIG. 1 is restricted by the cross member of arm 10. Anticlockwise movement of the arm 10 is restricted by a stop adjacent the axis 14 and clockwise movement of the arm 12 is restricted by the arm 10. By virtue of this arrangement the interlinked arms 10, 12 present an upper boundary to the stream 2 between the regions of the axes 8 and 14, this boundary being variable between a fixed lower position (as in FIG. 1) and a fixed upper position (indicated by chain-dotted lines in FIG. 1).

A second conveyor consisting of a pair of transversely spaced endless belts 16 (only one of which can be seen in FIG. 1) is arranged adjacent the delivery end of the conveyor 4. Each belt 16 passes around pulleys 18 and 20 arranged alongside each side of the end of the conveyor 4, the pulleys 20 being coaxial with the pulley at the delivery end of conveyor 4. Thus there is a belt 16 on each side of the band conveyor 4 between pulleys 18 and 20. The width of the band conveyor 4 and the spacing of the belts 16 are each less than the length of a cigarette to be conveyed. The pulleys 18 have a slightly larger diameter than the pulleys 20 and, since the belts 16 and the conveyor 4 are at the same level in the region of pulleys 20 and the axes of pulleys 18 and 20 lie in a horizontal plane parallel to the conveyor 4, the right hand end of the upper run of belts 16 as viewed in FIG. 1 is at a slightly higher level than the adjacent part of the conveyor 4. The positions of the axes of pulleys 18 may be vertically adjustable.

From the pulleys 20 the belts 16 have an inclined run to further pulleys 22. The run between pulleys 20 and 22 is inclined at an angle of about 28° to 30° to the horizontal. At the bottom of the run adjacent the pulleys 22 is a pair of spaced wedge-pieces 24 lying between the end of the run and a slatted third conveyor 26. At regularly spaced intervals the conveyor 26 has special slats which carry upstanding divider plates 28 which are adapted to enter the stream of cigarettes. The width of the plates 28 is such that they can pass between the belts 16 (as shown in FIG. 1). The height of the plates 28 is such that they project above the level of the stream 2' on the conveyor 26: the height of the stream on the conveyor 26 is approximately equal to that on the conveyor 4.

In the region above the junction of bands 16 and conveyor 26 is a control plate 30 pivoted at 32. A refuser roller 33 is rotatably mounted about axis 32. The edge of the plate 30 remote from pivot 32 is normally held on top of the stream 2' by means of a mechanical linkage 34 carrying a cam roller 35 in contact with a cam 36. The plate 30 is held at a level slightly below the height of the divider plates 28, the difference in levels being approximately the same as one cigarette diameter, and determines the height of the stream 2'. The linkage 34 is operated by cam 36, synchronised with the drive for conveyor 26, to release the plate 30 at the appropriate time and allow the divider plate 28 to pass under the control plate 30. The end of the plate 30 nearest the pivot 32 and the part of the arm 12 nearest pivot 14 (in the position shown in FIG. 1), together with a fixed control plate 38, define an approximately straight surface opposite the inclined run of the bands 16. This surface is inclined at an angle to the horizontal which exceeds the corresponding angle made by the bands 16 by about 8° or 9°.

Beyond the control plate 30 in the direction of movement of the stream 2' is a pair of top control bands 40. These bands are transversely spaced to allow a separator plate 28 to pass between their lowermost run and are effective to hold the level of the stream 2' in line with the trailing end of the control plate 30.

A pair of transversely spaced tamping members 42 is arranged above the stream 2' adjacent the band 40. Each member 42 has a narrow flat lower surface which is bevelled slightly at its right hand end as viewed in FIG. 1. The lower surfaces of the members 42 are at slightly different heights above the conveyor 26: the difference in levels may be of the order of 1 mm. The members 42 are connected by a generally U-shaped member 44 which is operated on by a cam 46 to give the members a vibratory movement. The spacing of the members 42 is sufficient to allow the tops of the divider plates 28 to pass between them.

The slatted conveyor 26 extends generally horizontally beyond the region just described past a loading position where a plunger 48 is arranged in opposition to a container 50 for cigarettes (see also FIGS. 2 and 3). The spacing between adjacent divider plates 28 on the conveyor 26, the width of the plunger 48 (measured along conveyor 26), and the corresponding dimensions of the container 50 correspond.

Referring now to FIGS. 2 and 3, as well as to FIG. 1, the plunger 48 is supported at each end by a vertical drive arm 52 rigidly attached to the plunger. The upper end of each arm 52 carries a link 54 (FIG. 1) which is pivotally mounted on an upper drive chain 56. The lower end of each arm 52 is similarly supported by means of a pivoted link 58 on a lower drive chain 60. The upper drive chain 56 passes around four similar toothed wheels 62, mounted on a structural part of the apparatus and arranged at the corners of a rectangle, and also passes around a toothed wheel 64 positioned inside the rectangle to cause one side of the locus of the chain to be reentrant as shown in FIG. 2. The lower drive chain 60 passes around similarly arranged toothed wheels 68 and 70. The wheels 62 and 68 need not be arranged as shown in FIG. 2: for example the wheels 62, 68 may be arranged so that the upper runs extending from wheels 64, 70 respectively are vertical. In this case there would be no re-entrant portions of the loci of the chains 56, 60. Other arrangements are possible but preferably the chains 56, 60 should have similar loci. The distance between the pivoting axes of each link 54 is the same as the radius of a toothed wheel 62; similarly the corresponding distance on each link 58 is the same as the radius of a toothed wheel 68 (which is the same as the radius of a wheel 62).

On the opposite side of the stream 2' of cigarettes to the plunger 48 is a movable transfer plate 72 which comprises an elongate member of L-shaped section, one arm of the L being horizontal and having a bevelled leading edge and the other arm of the L being mounted on a frame member 74. Instead of being horizontal the upper arm of the transfer plate 72 may be inclined slightly downwards, i.e. towards the left as viewed in FIG. 2. Fixed side plates 75 are arranged on each side of the transfer plate 72 between the conveyor 26 and container 50. At its ends the frame member 74 is supported by and movable on fixed rods 76. At a central position the frame member 74 is attached by a pair of tension springs 78 to a fixed part of the apparatus. Adjacent the springs 78 the member 74 is adjustably attached by means of a link 80 to a damper 82 which acts in parallel with the springs 78. The link 80 has a downwardly extending lug 84 which is positioned in the path of a drive member 86 carried by a drive chain 88.

A vertically pivoted catch member 90 is mounted just below each chain 60 near the container 50. One end of the member 90 is connected by a linkage 92 to the upper end of a vertical rod 94. The lower end of the rod 92 carries a cam member 96. The linkage 92 is biased by means of a spring 98 onto an adjustable stop 100.

Operation of the apparatus described with reference to FIGS. 1, 2 and 3 is as follows. The stream 2 of cigarettes is delivered on band conveyor 4 from a cigarette maker or other source. The top band conveyor 6 maintains a uniform stream height and controls the top cigarettes in the stream. Typically the stream may be about 13 cigarettes in depth.

As the stream 2 passes along conveyor 4 the lowermost cigarettes in the stream are lifted and accelerated by the bands 16 passing around pulleys 18, the bands 16 being driven at a rather greater speed than the band 4. The additional energy thus imparted to the stream 2 at this point tends to cause relative movement of the individual cigarettes in the stream to allow the stream to assume a compact formation, i.e. tending towards a honeycomb formation, the formation in which the stream has least potential energy.

The bands 16 are driven faster than the conveyor 4 and the stream 2 is conveyed by these bands in the region between the pulleys 18 and 20. Beyond the pulley 20 the stream is driven down the incline towards the slatted conveyor 26. The pivoted arms 10 and 12 above the stream 2 in the region provide a variable reservoir which can expand (by clockwise pivoting of arm 10 and anticlockwise pivoting of arm 12) to absorb to a limited amount fluctuations in flow rate between the infeed conveyor 4 and the conveyors 16 and 26. As will be explained later, at certain stages in the cycle of operation of the apparatus both the bands 16 and the conveyor 26 are stationary and during these stages the conveyor 4 may continue to move with the reservoir constituted by arms 10 and 12 absorbing the flow of the stream.

The spaced divider plates 28 carried by the conveyor 26 enter the stream whilst it is on the inclined surface of the bands 16, the lowermost cigarettes being supported by their ends on the spaced bands whilst the divider plates enter between the bands. The plates 28 have rounded the pulley at the end of conveyor 26 and are vertical by the time they start to enter the stream. In order that the plates 28 should enter the stream easily it has been found advantageous to arrange for the stream to have a 'loose honeycomb' formation with lines of formation running vertically (i.e. parallel to the entering divider plate 28). The cigarettes may be considered to fall about the dividing plate as the latter progressively projects above the bands 16. The inclinations of the bands 16 and of the top plate 38 already specified have been found to produce satisfactory results.

It has been mentioned that the bands 16 travel faster than the conveyor 4: they also travel faster than the conveyor 26 and this helps to reduce the risk of producing a void behind the divider plate 28 (which travels at the same speed as the conveyor 26). Typical speeds of travel are: conveyor 4–32 ft./min., bands 16–41 ft./min., conveyor 26–33 ft./min. The top bands 6 and 40 normally travel at the same speed as the conveyors 4 and 26 respectively.

The transfer of the stream 2 from the bands 16 onto the conveyor 26 is smoothed by the wedge-pieces 24; the stream may be considered to drop in height in relation to the divider plates as it is transferred onto the conveyor. The height of the stream 2' on the conveyor 26 is set by the control plate 30 which is normally (i.e. intermediate the divider plates 28) held firmly at a predetermined height above the conveyor. This height is preferably about 8 mm or about 1 cigarette diameter less than the height of the divider plates 28.

The control plate 30 is held in position by the linkage 34 acted on by the cam 36 which is driven in synchronism with the drive for the conveyor 26. As a divider plate 28 reaches the control plate 30 a section 37 of reduced radius on the cam 36 comes into opposition with the cam roller 35 on the linkage 14 and releases the linkage from pressure from the cam. This allows the divider plate 28 to lift the control plate 30 and pass underneath it. Any cigarettes which tend to stay on top of the divider plate 28 are rolled away as the plate 28 passes under the control plate 30. The roller 33 which rotates continuously in an anticlockwise direction as viewed in FIG. 1 acts as a refuser roller as control plate 30 is lifted by the divider plates. The height of the control plate 30 above the conveyor 26 is adjustable vertically so that different heights of stream 2' may be accommodated, possibly for use with different divider plates 28 and containers 50.

After the control plate 30 a pair of top control bands 40 (acting on the ends of the cigarettes) hold the stream 2' at the level set by the control plate 30 until the ends of the uppermost cigarettes are engaged by the bevelled leading edges of the tamping members 42. These members 42 are driven by the cam 46 so that they move in a vibratory up and down motion on top of the stream 2' and tend to tamp the cigarettes into a closepacked honeycomb formation. In the case of filter-tipped cigarettes the member 42 which acts on the filter tip end of the cigarettes is advantageously positioned at a level somewhat lower than the member 42 acting on the tobacco end: the difference in levels may be about 1 mm. The effect of this is to press down the filter tip ends of the cigarettes rather more than the tobacco ends. In this way a compact formation can be achieved whilst ensuring that the majority of any mechanical shock to the cigarettes is directed to the end which is better able to withstand it. Moreover, the additional tamping to the filter tip end of the cigarette has another advantage. Since the filter tips tend to be more resilient than tobacco it is possible for the side of the stream at the filter tip end of the cigarettes to be higher than the side at the other end due to tip "build-up", the filter tips being rather less compressible than tobacco. This results in an undesirable inclined surface at the top of the stream. The present arrangement whereby the filter tip ends of the cigarettes are subjected to additional or more severe tamping helps to avoid or reduce this effect. It has been mentioned that the difference in levels between the tamping members may be of the order of 1 mm: this may be adjusted for differing tip compensations required for differing types of cigarette.

In an arrangement as shown in the drawings the members 42 may operate through 21 cycles of movement during the time taken for the conveyor 26 to move through the distance between divider plates 28. As shown in the drawings the members 42 are subjected to vertical movement by the cam 46. As an alternative the members could also be subjected to a horizontal component of movement along the line of conveyor 26 so that they perform a rotary movement on top of the stream 2'.

A further alternative is shown in FIG. 4 which illustrates the region of the apparatus of FIG. 1 immediately downstream of the control plate 30, in which the top control bands 40 are retained but the members 42 are replaced by a pair of transversely spaced inclined bands 142. The bands 142 pass around pulleys 144, positioned adjacent and at the same level as the bands 40, and also around further spaced pulleys 146 at a lower level, thus defining inclined lower runs of the bands 142. As with the bands 40 and the members 42, the bands 142 are spaced sufficiently to allow the tops of the divider plates 28 to pass between them. Also as with the members 42, one of the bands 142 may be at a slightly lower level than the other. The effect of the bands 142 on the top of the stream 2' is to cause it to be compressed and assume a tight formation: the bands 142 therefore replace the members 42 in function as well as position. It has been found that the bands 142 are especially saitsfactory when the apparatus is used for conveying filter plug rods. A single pair of bands could be used to perform the functions of the bands 40 and 42.

A still further arrangement (not illustrated) which may be used to impart a close-packed honeycomb formation to the stream 2' is to provide an undulating path of movement for the conveyor 26. In this way, the constant jostling of the cigarettes in the stream 2' gives them sufficient energy for the stream to assume a compact formation. This type of conveyor could be used in conjunction with tamping members or bands as previously described.

Referring more particularly again to FIGS. 1 to 3, after the stream 2' has passed the tamping members 42 (or the bands 142) it is in a compact formation and is bounded at its forward end (considered in the direction of movement of conveyor 26) by a divider plate 28, which has already been inserted into the stream, and is being separated from the stream 2 on the conveyor 4 and bands 16 by the succeeding divider plate 28. In this respect it may be noted that, although FIG. 1 depicts the length of conveyor 26 as such that the distance between the lower end of the inclined bands 16 and the plunger 48 is less than the distance between successive divider plates 28, this length could be much greater so that several divider plates 28 are upright on the upper run of conveyor 26 at the same time.

Thus a batch of cigarettes comprising at least part of the stream 2' bounded at its ends by divider plates 28 is formed on the conveyor 26. The conveyor 26 continues to be driven until the divider plates 28 are in alignment with the ends of the plunger 48 with the batch of cigarettes on the conveyor between the divider plates and opposite the plunger. Then the conveyor 26 and its associated drives are stopped; the conveyor 4 and top band 6 may continue moving the stream 2 as previously explained.

When the conveyor 26 stops, the plunger 48, which is in the position shown in the drawings (but may be moving), is moved by its drive chains 56 and 60, through drive arm 52, towards the adjacent side of the batch of cigarettes (i.e. towards the ends of the cigarettes in the batch). The chains 56 and 60 move along parallel paths at the same speed and hence maintain the drive arm 52 and plunger 48 in a vertical position. The plunger 48 is moved over the conveyor 26 between the divider plates 28 and engages the ends of the cigarettes in the batch and moves the batch transversely off the conveyor onto the transfer plate 72. The spacing of the fixed side plates 75 is the same as that of the divider plates 28; as the batch is moved off the conveyor 26 onto the transfer plate 72 the side plates 75 retain it at its ends.

The drive source for the chains 56 and 60 also operates the drive chain 88. As the plunger 48 advances the batch onto the transfer plate 72 the chain 88 is timed so that the drive member 86 carried by the chain engages the lug 84 and carries the transfer plate 72 forward at about the same speed as the plunger. Movement forward of the transfer plate 72 extends the tension springs 78 and withdraws the piston of damper 82. The batch is carried forward by the plunger 48 and transfer plate 72 together until the plunger and transfer plate occupy the position indicated by chain-dotted lines in FIG. 2. In this position the batch is supported within the container 50. As shown in FIG. 2 the batch is inserted somewhat above the previous batch already in the container so as to avoid the possibility of damaging the outer ends of the uppermost cigarettes in the previous batch. The spacing between the uppermost cigarettes of the previous batch and the transfer plate 72 has however been somewhat exaggerated in FIG. 2. As mentioned earlier, the transfer plate 72 may be inclined slightly, in order to compensate for any residual "tip build-up" in batches of cigarettes already present in the container.

In order to ensure that the batch is pushed into the container without damage to the cigarettes at or near the ends of the batch the catch members 90 centralise the container 50 so that its sides are in alignment with the side plates 75. As the drive member 86 moves the transfer plate 72 and attached frame member 74 forward, part of the frame member 74 on each side engages the corresponding cam member 96. This pivots the rod 94 which in turn moves the linkage 92 off its stop 100 and rotates each catch member 90 from the position shown in FIG. 3 into a position in which the inner side edges of the container 50 are engaged. If the container is not centralised with respect to the batch or if the sides of the container are bowed inwards slightly the catch members remedy the situation.

When the plunger 48 and the transfer plate 72 reach the position indicated by the chain-dotted lines in FIG. 2 the drive chains 56 and 60, and 88, do not stop but continue to be driven at the same rate. This causes drive member 86 on drive chain 88 to become disengaged from the lug 84 as member 86 rounds the forward pulley of drive chain 88. The transfer plate 72 is then withdrawn from underneath the batch under the action of springs 78; return of the transfer plate to its original position under the action of the springs is damped by damper 82. The frame member 74 is returned with the transfer plate and consequently the cam members 96 are disengaged with the result that the catch members 90 rotate out of engagement with the sides of the container 50 under the action of springs 100.

The batch of cigarettes is held laterally by the plunger 48 as the transfer plate 72 is withdrawn and falls the short distance already mentioned onto the previous batch in the container 50 (or, if it is an empty container, onto the bottom of the container). In order that the plunger 48 should have a dwell period during which it remains stationary whilst the transfer plate 72 is withdrawn, even though the drive chains 56 and 60 remain in motion, the pivoted links 54 and 58, by which each drive arm 52 is attached to the corresponding chains 56 and 60 respectively, rotate about an axis which passes through the axes of the adjacent pulleys 62 and 68 respectively and the corresponding axes of pivoting on the drive arm 52. Since the distance between the respective axes on the pivoted links 54 and 58 is the same as the radius of the pulleys 62 and 68 respectively, the chains 56 and 60 respectively can move through 180° relative to the pulleys without causing any lateral movement of the drive arm 52. Thus there is a dwell period whilst the plunger 48 remains in its forward position before being withdrawn prior to plunging another batch of cigarettes.

The drive chains 56 and 60 move the drive arms 52 and plunger 48 upwards after withdrawal from their forward position and the plunger 48 is returned over the conveyor 26 well above the tops of the divider plates 28. It should be understood that the conveyor 26 is stopped momentarily whilst the plunger 48 moves across it between divider plates 28 and moves a batch of cigarettes fully onto the transfer plate 72. Thereafter the conveyor 26 is restarted and a further batch having a leading end retained by the rear divider plate 28 of the previous batch begins to move into position. The plunger 48 is returned over this further batch as it moves into position and is ready to move forward and push it onto the transfer plate 72 at the appropriate time. The timing may be such that the drive chains 56 and 60 do not stop.

After a batch has been received by the container 50 drive means move the container downwards by an amount equal to the height of a batch so that the container is ready to receive the next batch. A container may be capable of receiving several batches, e.g. four, and when full is replaced by an empty container, the full container being transferred to a storage area or to a packing machine or other unloading position. An arrangement for moving containers vertically past a loading position is described in more detail in said U.S. Pat. No. 3,967,780. This specification also describes ways of handling containers, both prior to and after filling, which may be used with the present apparatus.

When batches of cigarettes are moved transversely from a conveyor into a container it is important that the cigarettes should be maintained in alignment since otherwise delay in operation or even damage to the apparatus may occur. Generally speaking, the cigarettes in the middle of a batch are unlikely to cause any trouble in this respect and it is in particular the cigarettes at or near the top ends of the batch which are most likely to become misaligned. Control of these latter cigarettes is made more difficult if the batch is retained by end plates whose height barely exceeds that of the batch. Moreover, the end plates may have rounded or bevelled tops (to allow them to more easily enter a stream of cigarettes without causing damage) and some clearance must exist between the end plates and the plunger which transfers the batch from its conveyor into a container. As a result the clearance at the top corners of the batch could be such that insufficient control of the cigarettes in this region is exercised to prevent possible misalignment of the cigarettes as the batch is transferred. It is important to realize that the present arrangement at least partly overcomes this problem by providing apparatus whereby it is possible to ensure that the divider plates which form the end plates for the batches may be projected fully through the stream (without causing misalignment of the cigarettes in the upper part of the stream) and extend above the height of the stream so that adequate control of the top ends of the batches may be achieved when the plunger is operated to transfer the batches transversely into a container. The control of the upper part of the stream by members 30, 40 and 42 (or 142) and the progressive introduction of the divider plates 28 into the stream are helpful in this respect.

It is contemplated that apparatus of the present type could be used in a reverse mode, i.e. as apparatus for unloading containers of cigarettes and assembling them into a continuously moving stream. Thus batches of cigarettes could be removed from a container and assembled on the conveyor 26 between divider plates 28. In said U.S. Pat. No. 3,967,780 means for removing batches from containers are disclosed in the form of a pusher which is opposed to a plunger such as the plunger 48 and pushes batches of cigarettes out onto a conveyor. In this arrangement the containers are in the form of frame trays and have neither a back nor a front; the trays are provided with compartments, each of which serves to hold a batch of cigarettes. In an alternative arrangement, also disclosed in said patent specification for use with trays having compartments, a plunger such as the plunger 48 approaches the container from the same side as the plunger and withdraws a batch of cigarettes for transfer onto a conveyor. In this case the containers may have backs. Either of these arrangements could be used to transfer batches of cigarettes from a container on to the conveyor 26. Further details of the arrangements are disclosed in said patent specification.

In an arrangement for use with containers not having compartments the plunger 48 could be modified so that suction can be applied to the face which comes into contact with the ends of the cigarettes in a batch. Suction could then be applied and released at appropriate times so that successive batches are withdrawn from containers for transfer over the transfer plate 72 onto the conveyor 26. The possible position of a suction manifold attached to the plunger 48 is indicated in chain-dot lines at 250 in FIG. 2. Suction could be supplied to the manifold through an extendible coupling pipe 252 and applied to the ends of the rod-like articles in a batch via perforations 254 in the face of the plunger 48.

After removal from a container a batch of cigarettes is positioned on the stationary conveyor 26 between divider plates 28 and subsequently the conveyor is restarted but travels in the reverse direction i.e. from left to right as viewed in FIG. 1. A continuous stream is thus established on conveyor 4 by unloading successive batches of cigarettes onto the conveyor 26, the divider plates 28 being withdrawn as the stream moves up the inclined path defined by conveyor 16. Where the conveyor 16 is to be used for moving the stream upwards it may be advantageous to provide small spaced ridges, e.g. of semi-circular section, on the surface of the belts defining conveyor 16 in order to positively drive the stream up the incline. In this case it has been found advisable for the horizontal component of velocity of conveyor 16 to equal the velocity of conveyor 26. It is to be understood that if the apparatus of FIG. 1 is operated in the reverse mode the conveyors 4, 6, 16 and 40, as well as conveyor 26 are reversed.

As well as being capable of a reverse mode of operation the apparatus of FIG. 1 may be operated in a reversible system such that the apparatus fills containers or empties them according to demand. Thus it may constitute a buffer, for example, between a packer and a maker.

Although the apparatus has generally been described with reference to cigarettes it should be understood that it may equally well be used for other rod-like articles, in particular for multiple plug lengths.

Control of the apparatus of FIGS. 1 to 4 for loading containers may be better understood by reference to FIG. 5 which shows in diagrammatic form part of an apparatus which is basically the same as that of FIG. 1. Parts of the apparatus of FIG. 5 which are equivalent to parts identified in FIG. 1 have been given a similar reference number but increased by 200. Some additional ancillary equipment is shown in FIG. 5. This equipment comprises a pair of bands 201, 203, which feed a transverse single layer of cigarettes from a cigarette making machine onto a band conveyor 209. An end guide 207 is positioned between the band 203 and the conveyor 209 and a movable sensor 205 is arranged above the conveyor adjacent the bands. The other end of the conveyor 209 is adjacent a conveyor 204 and lies beneath a pivoted movable sensor 211. The remainder of the apparatus has already been described with respect to FIG. 1.

Consider the apparatus in a position where a divider plate 228 on the conveyor 226 is under the control plate 230. The conveyor 226 is stationary, as also are the bands 216 and 240 which are driven in synchronism with conveyor 226. At this point it may be noted that part of the apparatus, in particular that part comprising the plunger and the tray feed, is not illustrated in FIG. 5. However, for the purposes of control it is sufficient to consider control of conveyor 226 since the parts referred to are driven in synchronism with this conveyor. The reservoir sensor arms 210, 212 are in their lowermost positions and the sensors 211 and 205 are also in their low or unoperated positions. The conveyors 204, 206 and 209 are stationary.

A single transverse row of cigarettes is fed from a cigarette making machine by the bands 201, 203 onto the conveyor 209. A stack of cigarettes therefore builds up on the stationary conveyor. When the stack reaches a predetermined height the sensor 205 will be operated and cause conveyor 209 to start moving. Sub sequently the speed of conveyor 209 is under the proportional control of sensor 205, i.e. the speed of the conveyor is determined by the height of the stack above a predetermined level as measured by the sensor. The stack formed on conveyor 209 is driven under sensor 211 which is thereby lifted and operated to cause conveyor bands 204 and 206 to move, again under proportional speed control determined by sensor 205. With conveyors 204, 206 and 209 moving, a stack of cigarettes is propelled over the stationary inclined conveyor 216 and up to the stationary divider plate 228.

As more cigarettes are delivered onto the conveyor 209 and are propelled forward as a stack by the band conveyors 204, 206, the region up to the divider plate becomes filled and the stack expands upwards causing the reservoir arms 210, 212 to rise from their low limit through a low level zone into their working zone. This causes the sensor arms 210, 212 to switch a circuit so that the conveyor 226 and bands 216 and 240 run, again under proportional speed control of sensor 205. The stack is then conveyed forward by the conveyor 226 until it reaches a position where a batch is ready for plunging into a container. As has already been described, the conveyor 226 then automatically stops and the reservoir sensor arms 210, 212 take up the flow from the bands 201, 203 and conveyors 209, 204, 206 whilst the conveyor is stationary, which may be for a period of the order of one second. When the conveyor 226 (and bands 216, 240) start again the excess in the reservoir formed by arms 210, 212 is removed and as long as the sensor arms remain in their working zone the apparatus can operate continuously.

If for some reason the cigarette flow from the maker stops or is seriously reduced the sensor 205 will fall and first reduce the speeds of all the conveyors (by its proportional control) if these speeds are above their predetermined minimum and will subsequently stop conveyors 209, 204 and 206. The reservoir sensor arms 210, 212 will fall until, when they reach their low limit, the conveyor 226 and bands 216 and 240 are also stopped.

Conversely, if there is a fault in the plunging mechanism, for example so that the conveyor 226 is not moving the stack, either at all or quickly enough to compensate for the rate of supply, the reservoir sensor arms 210, 212 will rise until they reach their high limit at which they operate to switch off the cigarette making machine (or its feed). When the fault has been rectified the plunger will operate and the conveyor 226 run, gradually emptying the reservoir under arms 210, 212 until the arms fall to their low limit and stop the conveyor 226. The cigarette making machine can then be restarted and the loading apparatus will perform as previously described. The loading apparatus may be constructed so that in the event of a fault the plunger will not operate and will initiate the previously described sequence of events whereby the feed from the cigarette making machine is stopped.

The region over the conveyor 209 between the sensors 211 and 205 is open to provide for hand sampling. If a particularly large sample is taken so that a void occurs in the stack the sensor 211 will drop and cause bands 204 and 206 to stop. This in turn may cause sufficient interruption to the flow for reservoir arms 210, 212 to reach their low limit and stop conveyor 226. Subsequently as the void is filled by incoming cigarettes the sensor 211 is operated again causing bands 204, 206 to run and fill the reservoir so that arms 210, 212 are raised into their working zone and conveyor 226 restarted.

It will be appreciated that the operation of the reservoir formed by the sensor arms 210, 212 is important to correct functioning of the apparatus. The positions of the arms determining the size of the reservoir can be an indication of the operating state of the apparatus. As has already been mentioned, at the low limit of the arms' movement the conveyor 226 and remainder of the tray filler drive are stationary and at the high limit the cigarette maker (or its feed) is stopped. Adjacent these limits are high level zones and low level zones which represent fault conditions, either in the cigarette maker or in the loading apparatus. Between the high and low level zones is the normal working zone; this may be positioned nearer the low level zone with a safety margin between it and the high level zone to allow for the rise in levels expected in the reservoir as the conveyor 226 is stopped to allow the plunger to operate.

It is quite possible for the output of more than one cigarette making machine to be supplied to a single loading apparatus. Where this is the situation a single stream consisting of a moving stack of transversely aligned cigarettes is produced by fusing together the stream flowing from each machine. This single stream may be fed from an elevated position through a vertical channel onto the conveyor 209. The sensor 205 is replaced by a sensor at the top of the down drop through the vertical channel. As with the sensor 205 this sensor detects the incoming flow and controls the speeds of conveyor bands 209, 204, 206, 216, 226 and 240 appropriately. The other controls remain as described with reference to FIG. 5.

We claim:

1. Apparatus for filling and unloading a container with rod-like articles, comprising a first conveyor for moving a stream of said articles along said path, a second conveyor for receiving the stream and for moving it along a second path towards a third path, the second path being inclined to the first path and to the third path, a third conveyor arranged to convey the stream along the third path, drive means for moving said second and third conveyors and arranged so that the stream may be conveyed at different speeds on said second and third paths, spaced separating means movable with the third conveyor and arranged to be successively projected into the stream on the second path to divide the stream into batches, means for moving successive batches transversely of said third path off the third conveyor and into a container and for successively removing batches of rod-like articles from a container and transferring them onto the third conveyor between spaced retaining means defined by said separating means.

2. Apparatus according to claim 1 wherein at least the parts of the first and third paths adjacent the second path are parallel.

3. Apparatus according to claim 2 wherein the first and third paths are respectively upper and lower substantially horizontal paths.

4. Apparatus according to claim 1 wherein a variable capacity reservoir for rod-like articles is provided in the region of the junction between the first and second paths.

5. Apparatus according to claim 3 wherein the separating means comprises a series of spaced divider plates carried by the third conveyor and adapted to be projected into the stream.

6. Apparatus according to claim 5 wherein the third conveyor has a horizontal run underneath the inclined path defined by the second conveyor so that the divider plates carried by the third conveyor may progressively enter the stream on the second path as the second and third conveyors converge.

7. Apparatus according to claim 6 wherein the second conveyor comprises transversely spaced belts arranged to support the ends of the rod-like articles and defining a space between them through which a divider plate may project into the stream supported on the belts.

8. Apparatus according to claim 1 wherein the means for moving batches to or from the third conveyor comprises a pusher to which suction may be applied for moving batches in the reverse direction.

9. Apparatus for filling a container with rod-like articles, comprising a first conveyor for moving a stream of said articles along a first path, a second conveyor for receiving the stream and for moving it along a second path towards a third path, the second path being inclined to the first path and to the third path, a third conveyor arranged to convey the stream along the third path, spaced separating means movable with the third conveyor and arranged to be successively projected into the stream on the second path to divide the stream into batches, and a piston-type pusher for moving successive batches transversely of said third path off the third conveyor and into a container, further including a movable transfer plate onto which a batch is transferred from the third conveyor and on which the batch is moved into a container, and means for withdrawing the transfer plate while leaving the batch in the container.

10. Apparatus according to claim 9 wherein the transfer plate is inclined at a slight angle to the third conveyor so that the inclination of rod-like articles in a batch is changed on transfer to the transfer plate.

11. Apparatus for filling a container with rod-like articles, comprising a first conveyor for moving a stream of said articles along a first path, a second conveyor for receiving the stream and for moving it along a second path towards a third path, the second path being inclined to the first path and to the third path, a third conveyor arranged to convey the stream along the third path, spaced separating means movable with the third conveyor and arranged to be successively projected into the stream on the second path to divide the stream into batches, means for moving successive batches transversely of said third path off the third conveyor and into a container, and locating means synchronized with and intermittently operable by said means for moving batches into a container, said locating means being effective to accurately position a container to receive a batch.

12. Apparatus for filling a container with rod-like articles, comprising a first conveyor for moving a stream of articles along a first path, a second conveyor for receiving the stream and for moving it along a second path towards a third path, the second path being inclined to the first path and to the third path, a third conveyor arranged to convey the stream along the third path, a control plate spaced from the third conveyor for defining the maximum height of a stream of articles on the third path, spaced separating means comprising at least one divider plate carried by the third conveyor and arranged to be successively projected into the stream on the second path to divide the stream into batches, the control plate being released to allow the divider plate to pass by means synchronised with the third conveyor, and means for moving successive batches transversely of said third path off the third conveyor and into a container.

13. Apparatus for filling a container with rod-like articles, comprising a first conveyor for moving a stream of said articles along a first path, a second conveyor for receiving the stream and for moving it along a second path towards a third path, the second path being inclined to the first path and to the third path, a third conveyor arranged to convey the stream along the third path, a pair of transversely spaced members acting on opposite ends of the upper rod-like articles in the stream on the third conveyor to cause said stream to assume a more compact formation, spaced separating means movable with the third conveyor and arranged to be successively projected into the stream on the second path to divide the stream into batches, and means for moving successive batches transversely of said third path off the third conveyor and into a container.

14. Apparatus according to claim 13 wherein one of said pair of members is set slightly closer to the third conveyor than the other.

15. Apparatus according to claim 13 wherein said members are arranged to reciprocate and intermittently make contact with the upper rod-like articles in the stream.

16. Apparatus according to claim 13 wherein said members are endless bands set at a slight inclination to the third conveyor.

17. Apparatus according to claim 13 in which the separating means comprises at least one divider plate carried by the third conveyor, wherein the height of a stream on the third conveyor is controlled by means of a pair of spaced members which act on the ends of the upper rod-like articles in the stream and allow the divider plate to pass between them.

18. Apparatus for filling a container with rod-like articles comprising a conveyor for feeding a stream of rod-like articles including upper and lower conveyor means connected by a generally inclined path, means for successively dividing the stream into batches, transfer means for moving successive batches transversely off the conveyor into a container, said transfer means including a movable transfer plate arranged between the conveyor and the container, first means for moving a batch of rod-like articles transversely off the conveyor onto the transfer plate and into said container while on said transfer plate, and means for advancing said transfer plate having said batch thereon only with said first means and for withdrawing the transfer plate prior to withdrawing of said first means while leaving the batch in the container.

19. Apparatus according to claim 18 wherein the transfer plate is inclined at a slight angle to the conveyor so that the inclination of rod-like articles in a batch is changed on transfer to the transfer plate.

20. Apparatus for filling a container with rod-like articles comprising conveyor means for feeding batches of rod-like articles, and pusher means for moving successive batches transversely of said conveyor means into a container, further including locating means synchronised with and intermittently operable by said pusher means effective to engage and accurately position a container prior to receiving a batch.

21. Apparatus according to claim 20 further comprising means for successively dividing a stream of rod-like articles on said conveyor means into batches.

22. Apparatus for filling a container with rod-like articles, comprising conveyor means for moving a stream of rod-like articles including upper and lower conveyor means connected by a generally inclined path, spaced separating means including at least two divider plates arranged to move with said conveyor means and divide said stream into batches, a control plate spaced from said conveyor means for defining the maximum height of the stream on said conveyor means, means synchronised with said conveyor means for normally holding said control plate in position and for permitting raising of the control plate by the divider plate to allow the divider plate to pass thereunder and subsequently to release the control plate to allow it to lower onto the stream after passage of the divider plate, and means for transferring batches of rod-like articles from the conveyor means into a container.

23. Apparatus for filling a container with rod-like articles, comprising conveyor means for moving a stream of rod-like articles including upper and lower conveyor means connected by a generally inclined path, batch-forming means for dividing said stream into batches, a pair of transversely spaced members spaced above said conveyor means and arranged to act at transversely spaced positions on the upper surface of the stream of rod-like articles on said conveyor means to cause said stream to assume a more compact formation, one of said pair of transversely spaced members being set slightly closer to said conveyor means than the other, and means for transferring batches of rod-like articles from the conveyor means into a container.

24. Apparatus according to claim 23 in which the batch-forming means includes at least one divider plate movable with said conveyor means, wherein said transversely spaced members are so positioned that the upper end of the divider plate may pass between them.

* * * * *